United States Patent [19]

Arai et al.

[11] Patent Number: 4,871,401

[45] Date of Patent: Oct. 3, 1989

[54] FLUIDIZED BED METHOD OF FORMING A NITRIDE OR CARBONITRIDE LAYER

[75] Inventors: Tohru Arai; Junji Endo; Hiromasa Takeda, all of Aichi, Japan

[73] Assignee: Kabushiki Kaisha Toyota Chuo Kenkyusho, Japan

[21] Appl. No.: 123,662

[22] Filed: Nov. 13, 1987

[30] Foreign Application Priority Data

Nov. 18, 1986 [JP] Japan ..... 61-276371

[51] Int. Cl.[4] ..... C21D 1/74

[52] U.S. Cl. ..... 148/14; 148/16; 148/16.6

[58] Field of Search ..... 148/16, 16.5, 16.6, 148/70.3, 6.35, 6.3; 427/213, 216, 217, 185

[56] References Cited

U.S. PATENT DOCUMENTS 3,197,346 7/1965 Munday ..... 148/16.5
4,481,264 11/1984 Faune ..... 428/627

OTHER PUBLICATIONS

Metals Handbook, vol. 4, Heat Treating, pp. 299–306, and vol. 5, Cleaning Finishing & Coating, pp. 542–545, ©1981.

*Primary Examiner*—Christopher W. Brody
*Attorney, Agent, or Firm*—Berman, Aisenberg & Platt

[57] ABSTRACT

A method of forming a nitride or carbonitride layer on the surface of an iron or iron alloy article, which comprises the steps of: (a) disposing in a fluidized bed furnace a treating agent comprising a refractory powder, a metal powder of at least one selected from the group consisting of chromium, vanadium, titanium and a metal containing at least one of the chromium, vanadium and titanium, and a halide powder; (b) introducing a nitrogen-containing gas into the fluidizied bed furnace; (c) heating the fluidized bed furnace; and (d) disposing the article in the fluidized bed furnace during or after the steps (a) to (c). In this method, the article is preferably treated at a temperature not higher than 650° C. The step (c) may precede the step (b). The halide powder may be supplied to the fluidized bed furnace from outside in the form of green compact or a gas.

19 Claims, 6 Drawing Sheets

(x400)

(x 400)

FLUIDIZED BED METHOD OF FORMING A NITRIDE OR CARBONITRIDE LAYER

RELATED APPLICATIONS

This application is related to application Ser. No. 814,578, filed Dec. 27, 1985 now abandoned; application Ser. No. 913,643 (now U.S. Pat. No. 4,686,117), filed Sept. 30, 1986; application Ser. No. 733,844 (now U.S. Pat. No. 4,569,862), filed May 14, 1985; application Ser. No. 23,862, filed Feb. 3, 1987 (now U.S. Pat. No. 4,765,847); and application Ser. No. 68,129, filed June 30,1987 now abandoned.

BACKGROUND OF THE INVENTION

1. Field of the Invention

The present invention relates to a method for surface treatment to form a layer of a nitride or carbonitride of at least one element selected from chromium (Cr), vanadium (V), and titanium (Ti) on the surface of iron or iron alloy articles, such as dies, jigs, and machine parts.

2. Description of the Prior Art

It is known that iron and iron alloy articles (referred to as articles to be treated hereinafter) are improved in abrasion resistance, seizure resistance, oxidation resistance, corrosion resistance, etc., when they are coated with a surface layer of a carbide, nitride, or carbonitride of one or more than one element of the group chromium, vanadium, and titanium. There have recently been proposed several methods for forming the surface coating layer. According to one of them, an article to be treated is coated with a surface layer of a nitride or carbonitride of chromium, vanadium, or titanium by the aid of plasma chemical vapor deposition from a halide of chromium, vanadium, or titanium. (For example, Japanese Laid-open Patent Publication Nos. 65357/1980 and 164072/1980.) An advantage of this method is that it is possible to form the surface layer without causing heat-induced strain to the base metal of the article to be treated because the treatment is carried out at a temperature lower than the $Ac_1$ transformation point of iron, which is about 650° C. However, this method has a disadvantage that it is difficult to form a surface layer superior in adhesion and uniformity of the thickness of the layer. An additional disadvantage is that the treatment needs complex steps and an expensive apparatus, and the treatment has to be carried out in hydrogen or under reduced pressure.

In order to overcome the disadvantages of the conventional method, the present inventors previously completed an invention relating to a method for surface treatment which comprises forming a surface layer of a nitride or carbonitride of chromium, vanadium, or titanium on the surface of an article to be treated at a low temperature below 700° C. (U.S. patent application No. 23,862) According to this method, at first, an article to be treated is subjected to nitriding to form a layer of iron-nitrogen compound or iron-carbon-nitrogen compound on the surface of an article to be treated. Subsequently, the article is heated at a temperature below 700° C. in a treating agent composed of a refractory powder, such as alumina, a material containing chromium, vanadium, or titanium, and a halogenated ammonium salt and/or a metal halide, said treating agent being fluidized by argon or the like. The second treatment permits chromium, vanadium, or titanium to diffuse into the compound layer formed by the nitriding. In this way, an article to be treated is formed with a surface layer of a nitride or carbonitride of chromium, vanadium, or titanium. (This method is referred to as dual treatment method hereinafter.)

The disadvantage of the dual treatment method is that it is necessary to carry out treatment twice at almost the same temperature, the first for forming a nitride or carbonitride of iron, and the second for diffusing chromium, vanadium, or titanium, thereby forming a nitride or carbonitride of one of these elements. Therefore, it is poor in efficiency and consumes a large amount of energy. In order to eliminate this disadvantage, the present inventors carried out extensive studies and found a method for forming in a single step the same surface layer of nitride or carbonitride as that formed by the dual treatment method. It is important to note that in the dual treatment method, the nitride or carbonitride constituting the surface layer can be made from any of vanadium (V), chromium (Cr), titanium (Ti), tungsten (W), and molybdenum (Mo) which have a large negative free energy for the formation of nitrides or carbonitrides, whereas in the single-step method of the present invention, the nitride or carbonitride can be made from vanadium, chromium, and titanium, but cannot be made from tungsten and molybdenum despite many attempts. In other words, the reaction associated with the formation of the surface layer in the present invention is not elucidated by the magnitude of free energy. Therefore, the present invention is not easily conceived on the basis of the prior art.

SUMMARY OF THE INVENTION

It is an object of the present invention to provide a method for efficiently forming on an article to be treated a surface layer of a nitride or carbonitride of at least one element of chromium, vanadium, and titanium, said surface layer having good adhesion to the base metal of the article to be treated, without causing strain to the base metal, by heat treatment at a low temperature with a simple apparatus.

The gist of the present invention resides in a method which comprises the steps of: (a) disposing in a fluidized bed furnace a treating agent comprising a refractory powder, a metal powder of at least one metal selected from the group consisting of chromium, vanadium, titanium and a metal containing at least one of chromium, vanadium and titanium, and a halide powder; (b) introducing a nitrogen-containing gas into the fluidized bed furnace; (c) heating the fluidized bed furnace; and (d) disposing the article in the fluidized bed furnace during or after the steps (a) to (c). In this method, the article is preferably treated at a temperature not higher than 650° C. The step (c) may precede the step (b). The halide powder may be supplied to the fluidized bed furnace from outside in the form of green compact or a gas.

DETAILED DESCRIPTION OF THE INVENTION

Figure 1:
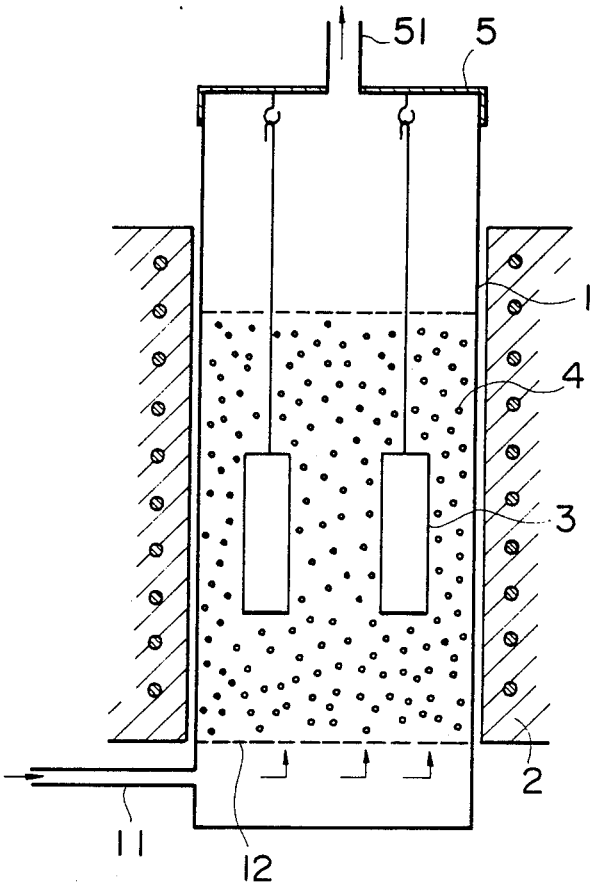
FIGS. 1, 4, 5, and 6 are schematic representations illustrating the apparatus used in the examples of the present invention.

According to the present invention an iron or iron alloy article is heat-treated to form a layer of a nitride or carbonitride of chromium, vanadium, or titanium on the surface thereof. The iron or iron alloy article may be one of carbon-containing iron, such as carbon steel, alloy steel, cast iron, and sintered alloy, or one of carbon-free iron, such as pure iron. It may or may not contain nitrogen.

The active agent added to the fluidized bed to form the layer is selected from halogenated ammonium salts, metal halides, alkali metal halides, and alkaline earth metal halides which sublime or evaporate at a temperature below the treating temperature. They may be used alone or in combination with one another. They may have a melting point higher or lower than the treating temperature. The active agent is usually used in the form of powder or green compact. It may be added during treatment or after treatment and prior to subsequent treatment.

The halogenated ammonium salts include $NH_4Cl$, $NH_4Br$, $NH_4F$, $NH_4I$, and $NH_4BF_4$. The metal halides include $TiF_4$, $VCl_3$, $VF_3$, and $FeCl_3$. The alkali metal halides and alkaline earth metal halides include NaCl, KCl, $KBF_4$, and $NaBF_4$.

The active agent should be preferably added in an amount of 0.05 to 20%, based on the total amount of the refractory powder and metal powder, so as to obtain a surface layer of sufficient thickness. With an amount less than 0.05%, it is difficult to form a layer of practical thickness. With an amount in excess of 20%, the active agent may generate a large amount of gas that may cause trouble such as pipe clogging.

The halide, when used in the form of powder, should preferably have a particle size of 60 to 350 mesh. When it is added during treatment or after treatment and prior to subsequent treatment, the halide gasifies immediately after addition, and the particle size is not so critical. The halide may be added in the form of green compact (e.g. pellets) or a gas.

The refractory powder (to . . . fluidizing) includes those which are inert and unreactive to the metal constituting the article to be treated. They are alumina ($Al_2O_3$), silicon oxide ($SiO_2$), titanium oxide ($TiO_2$), and zirconia ($ZrO_2$), which are commonly used for heat treatment. They may be used alone or in combination with one another.

The chromium, vanadium, or titanium readily combines with nitrogen or both carbon and nitrogen to form the surface layer of nitride or carbonitride. These metals may be replaced by any of their alloys, such as Fe-Cr, Fe-V, and Fe-Ti. These metals and alloys are used alone or in combination with one another.

The refractory powder and the chromium powder, vanadium powder, titanium powder, and their alloy powder should preferably have a particle size of 60 to 350 mesh. With a particle size coarser than 60 mesh, a large amount of gas is required to fluidize the treating agent and the flow rate of the fluidizing gas has to be extremely high. This reduces the residence time of the gas generated from the halide in the fluidized bed, which in turn makes it necessary to increase the amount of the active agent so that the gas generated from the halide exists in the fluidized bed. In addition, at an excessively high flow rate, the gas generated from the halide is exhausted before it reacts completely with the article to be treated, which makes it difficult to form the layer. Conversely, with a particle size finer than 350 mesh, the powder is difficult to handle because of its floating nature.

The fluidized bed-type furnace is a common one used for drying, incineration, reduction, etc. An example of such a furnace is shown in FIG. 1. The furnace (1) is provided with an inlet (11) for the fluidizing gas at its bottom and with a gas diffuser plate (12) near the inlet. The top of the furnace is covered with a lid (5) having an exhaust port (51). It is also possible to use a furnace of different structure, in which the furnace is integrally formed with the lid and it is provided with a door through which to insert and take out the article to be treated, etc.

The heat treatment is accomplished by heating the fluidized bed which acts as a heating medium. Heating may be accomplished by external heating or internal heating. In the former case, the fluidized bed-type furnace (1) is inserted into an external heater (2) such as an electric furnace as shown in FIG. 1. In the latter case, the fluidized bed is heated directly by a heater installed in the fluidized bed-type furnace.

The heat treatment should preferably be performed at a temperature below 650° C. so that the base metal of the article to be treated is immune against strain. The lower limit of the heat treatment temperature should preferably be 450° C. Heat treatment at a temperature lower than 450° C. is very slow to form the surface layer. Practically preferred temperatures are 500° C. to 600° C., at which die steel and structural steel are tempered.

The heat treatment carried out according to the present invention forms the surface layer which is made up of an outer layer and an inner layer underneath the outer layer. The outer layer is composed of a nitride or carbonitride of chromium, vanadium, or titanium as a principal component. The inner layer is composed of a nitride or carbonitride of iron. Under the surface layer is formed a diffusion layer of a solid solution composed of the base metal and a small amount of nitrogen. The surface layer becomes thicker as the heating time increases. Heat treatment in a short time provides a nitride layer or carbonitride layer containing more chromium, vanadium, or titanium. Therefore, the heat treatment time is determined according to the desired layer thickness and the desired content of chromium, vanadium, or titanium in the layer. It ranges from 1 to 50 hours.

Practically, the surface layer should be 3 to 15 μm thick, and the layer of nitride or carbonitride of chromium, vanadium, or titanium should be 1 to 10 μm thick. Layers thicker than these limits might lower the toughness of the treatable article.

Under certain conditions, the treating agent powder might clog the fluidizing gas inlet to check the normal fluidization. To prevent this trouble, coarse refractory particles (5–20 mesh) such as alumina may be interposed between the gas inlet and the treating agent powder.

A nitrogen-containing gas is selected from the group consisting of a nitriding gas such as nitrogen and ammonia, a mixed gas of a nitriding gas and a carburizing gas such as methane and propane, the nitriding gas with an inert gas such as argon, and the mixed gas with an inert gas. The fluidizing gas may also contain a small amount of hydrogen. These gases may be of normal purity.

The fluidizing gas should flow in the fluidized bed-type furnace at such a rate as to bring about sufficient fluidization. With an excessively low flow rate, fluidization is insufficient and the temperature distribution in the fluidized bed is poor. With an excessively high flow rate, the fluidizing gas is wasted and the operation is difficult to control on account of the excessive bubbling.

As the fluidizing gas is blown into the fluidized bed-type furnace, the treating agent is kept floating in the furnace by the upward gas flow.

No elucidation has been made as to the mechanism involved in the formation of the surface layer composed of a nitride or carbonitride of chromium, vanadium, or titanium. However, the following is presumed from the results of analyses by X-ray diffraction and microanalyzer and the relationship between the treating time and the layer thickness. (In the following description, m, n, o, and p each represent numerical values.)

During the treatment, nitrogen (N) diffuses from without into the iron or alloy iron constituting the article to be treated. The diffused nitrogen reacts with iron (Fe) in the surface of the article to be treated to form a nitride layer represented by $Fe_mN_n$. If there exists carbon (C) in the surface layer, or if the surface layer is supplied with carbon (C) from without, there is formed a nitride layer represented by $Fe_m(C_4N)_n$. Carbon (C) or nitrogen (N) which might be present in the treatable article also participates in the formation of $Fe_m(C,N)_n$. As the nitride layer is formed, a nitrogen solid solution (Fe-N) is also formed underneath the nitride layer. These reactions proceed inward from the surface.

The above-mentioned reaction is immediately followed by the second reaction or diffusion of chromium (Cr), vanadium (V), or titanium (Ti) into the nitride layer from without. Thus these two reactions proceed simultaneously. This diffusion replaces Fe in $Fe_mN_n$ or $Fe_m(C,N)_n$ with Cr, V, or Ti, converting the nitride layer into $(V,Fe)_oN_p$ or $(V,Fe)_o(C,N)_p$ or the like. This reaction proceeds gradually inward from the surface. Incidentally, the layer of $(V,Fe)_o(C,N)_p$ contains more V etc. in its outer part and more Fe in its inner part. Therefore, there is an instance where the outer part contains such a small amount of Fe that it is adequate to represent it by $V_o(C,N)_p$.

The thus formed surface layer, therefore, is composed of an outer layer of $(V,Fe)_oN_p$ or $(V,Fe)_o(C,N)_p$ and an inner layer (adjacent to the base metal) of $Fe_mN_n$ or $Fe_m(C,N)_n$.

It is presumed that the above-mentioned reactions are also accompanied by those reactions which deposit a compound of V etc. and N or a compound of V etc. and N and C directly on the surface of the article to be treated.

Thus there are formed a layer of $(V,Fe)_oN_p$ or $(V,Fe)_o(C,N)_p$; a layer of $Fe_mN_n$ or $Fe_m(C,N)_a$; and a layer of iron-nitrogen solid solution. It is possible to control the thickness of these layers, the ratio of the thicknesses of these layers, and the chemical composition of these layers by changing the kind of the base metal, the treating temperature and time, and the kind and mixing ratio of the treating agent.

The present inventors previously completed an invention referred to as dual treatment method.

The method of the present invention resembles the dual treatment method in that the article to be treated is formed with a surface layer of a nitride or carbonitride of chromium, vanadium, or titanium at a low temperature so that the article to be treated is not subject to heat-induced strain. However, they differ from each other in the following two aspects.

(A) Mechanism of formation of carbonitride layer

In the case of the dual treatment method, the first treatment forms a layer of an iron-nitrogen compound or an iron-carbon-nitrogen compound, and the second treatment forms a layer of chromium, vanadium, or titanium nitride or carbonitride through the replacement of iron in the nitride layer with chromium, vanadium, or titanium. Therefore, the thickness of the surface layer eventually formed on the treatable article is equal to that of the nitride layer formed by the first treatment. In other words, it depends on the nitriding treatment.

By contrast, according to the method of the present invention, the outer layer of a nitride or carbonitride of chromium, vanadium, or titanium, and the inner layer of a nitride or carbonitride of iron tend to become thicker in proportion to the treating time. (B) Characteristic properties of article to be treated The two methods provide the surface layers which are almost the same in hardness, abrasion resistance, and seizure resistance; however, they affect the toughness of the treatable article to a greatly different extent.

Nitriding is usually carried out in such a manner that a compound layer is not formed on the surface of the base metal in order to prevent the toughness of the base metal from decreasing. This usual practice is neglected in the previously filed dual treatment method. According to this method, it is necessary to form a thick compound layer, which is accompanied by a thick layer of iron-nitrogen solid solution. The fact that a large amount of nitrogen is present in the base metal of a treatable article is apparent from analyses with an X-ray microanalyzer as shown in the examples. The iron-nitrogen solid solution adversely affects the toughness of the base metal.

As compared with the dual treatment method, the treatment according to the present invention permits only an extremely small amount of nitrogen to diffuse into the base metal to form a solid solution and consequently forms a very thin layer of iron-nitrogen solid solution, as demonstrated in the examples given later. Therefore, it is believed that the article to be treated would be tougher in the case where the method of the present invention is employed than in the case where the dual treatment method is employed.

As mentioned above, according to the method of the present invention, an article to be treated is treated with a specific treating agent at a low temperature (preferably below 650° C.) so that chromium, vanadium, or titanium is diffused into the base metal of the article to be treated. Therefore, the method of the present invention makes it possible to form at a low temperature a superior surface layer of a nitride or carbonitride of one or more than one kind of chromium, vanadium, or titanium on the base metal of iron or iron alloy.

According to the method of the present invention, the base metal of iron or iron alloy is treated at a low temperature and consequently the base metal is hardly subject to strain. In addition, the treatment at a low temperature is easy to operate and does not need a large amount of energy.

According to the method of the present invention, the layer is formed by diffusion; therefore, the resulting surface layer is dense and practically thick and firmly adheres to the base metal despite the low temperature treatment, unlike the carbide layer or nitride layer formed by the PVD process which involves no diffusion reactions.

The dual treatment method requires two treating steps at almost the same temperature, whereas the method of the present invention forms the desired layer in one step of treatment. Therefore, the method of the present invention is more efficient and requires a less amount of energy and less equipment than the dual treatment method.

Moreover, according to the method of the present invention, it is possible to perform the surface treatment continuously if the halide compound as the active agent is supplied from time to time to the fluidized bed from outside during the surface treatment. It is also possible to add the active agent bit by bit, so that the amount of halogen gas exhausted from the fluidized bed can be reduced and a simple small piece of equipment is enough to dispose of the waste gas. The treatment can be carried out for a long period of time without the exchange of the treating agent. This saves the consumption of expensive chromium, vanadium, or titanium to form the nitride or carbonitride.

The invention is now described with reference to the following examples.

EXAMPLE 1

An article to be treated was treated to form a carbonitride coating thereon using a fluidized bed-type furnace as shown in FIG. 1, according to the method of the present invention. The fluidized bed-type furnace is constructed as follows: the furnace (1) is provided at its lower part a gas inlet (11) for argon for fluidization. Above the opening of the inlet is a gas diffuser plate (12) which divides the furnace into two sections. On the top of the furnace (1) is placed a removable lid (5), which is provided with an exhaust pipe (51) leading to a waste gas scrubber.

The furnace (1) is surrounded by a heater (2). The furnace (1) is made of heat-resistant steel and is cylindrical shape measuring 60 mm in diameter and 800 mm in height.

On the gas diffuser plate (12) of the fluidized bed-type furnace was placed 1 kg of treating agent composed of 59.5% of alumina powder (80-100 mesh), 40% of chromium powder (100–200 mesh), and 0.5% of ammonium chloride powder (80–200 mesh). Then, argon as the fluidizing gas was introduced under a pressure of 1.5 $kg/cm^2$ at a flow rate of 140 cm/min into the furnace (1) through the gas inlet (11). The treating agent became fluidized, forming the fluidized bed (4).

Figure 2:
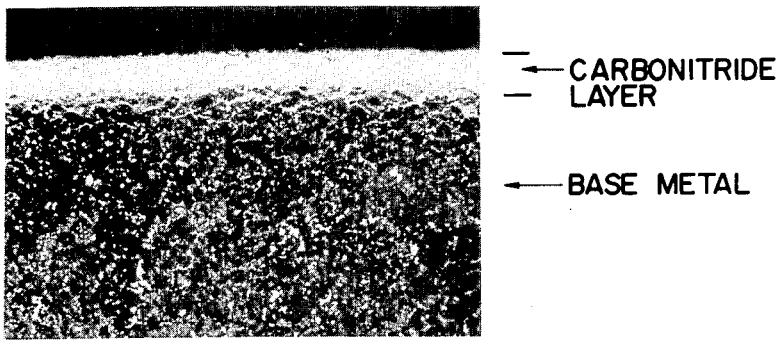
FIGS. 2 and 7 are microphotographs showing the cross-sectional structure of the carbonitride layer formed by the heat-treatment in Examples 1 and 3 of the present invention.
Figure 3:
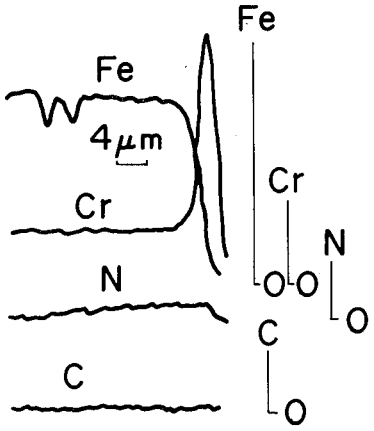
FIGS. 3, 8, and 9 are diagrams showing the results of analyses by an X-ray microanalyzer of the surface of the iron alloy treated in Examples 1, 3, and 4, respectively.

Then, two articles to be treated (3), made of high speed tool steel SKH51, measuring 7 mm in diameter and 50 mm in height, were suspended in the middle of the fluidized bed by means of supporters attached to the inside of the lid. With the top of the furnace proper tightly closed with the lid (5), the fluidized bed was heated to 560° C. Argon was switched to a 1:1 mixed gas of ammonia and nitrogen, which was introduced under the same pressure and at the same flow rate as argon. Treatment was carried out for 2 hours. The lid was removed and the treated articles were taken out of the furnace and quenched in oil. Upon visual inspection, the surface of the treated article was found to be smooth and free of the treating agent and uneven color. The coating layer formed on the treated article was uniform across thickness (12–13 $\mu$m) as shown in FIG. 2 which is a microphotograph of the cross-section of the coating layer. Upon examination by X-ray diffraction, this layer gave the diffraction line characteristic of CrN and $F_{2-3}N$. The cross-section of this sample was subjected to line analysis with an X-ray microanalyzer. The result shown in FIG. 3 suggests the presence of Cr, Fe, N, and C in the surface layer. Thus it was confirmed that the surface layer formed in this example is composed of an inner layer of iron carbonitride $Fe_m(C,N)_n$ and an outer layer of chromium-iron carbonitride $(Cr,Fe)_o(C,N)_p$.

The adhesion of the surface layer was evaluated by using a Rockwell hardness tester. The indentor was pressed against the specimen under the condition for the "C" scale (150 kg load), and the change of the layer that occurred around the indent was observed. The layer formed by the method of the present invention did not peel off but remained in good adhesion although cracks occurred radially around the indent. (The base metal was swollen at the periphery of the indent and the layer was subjected to tensile stress.)

EXAMPLE 2

Figure 4:
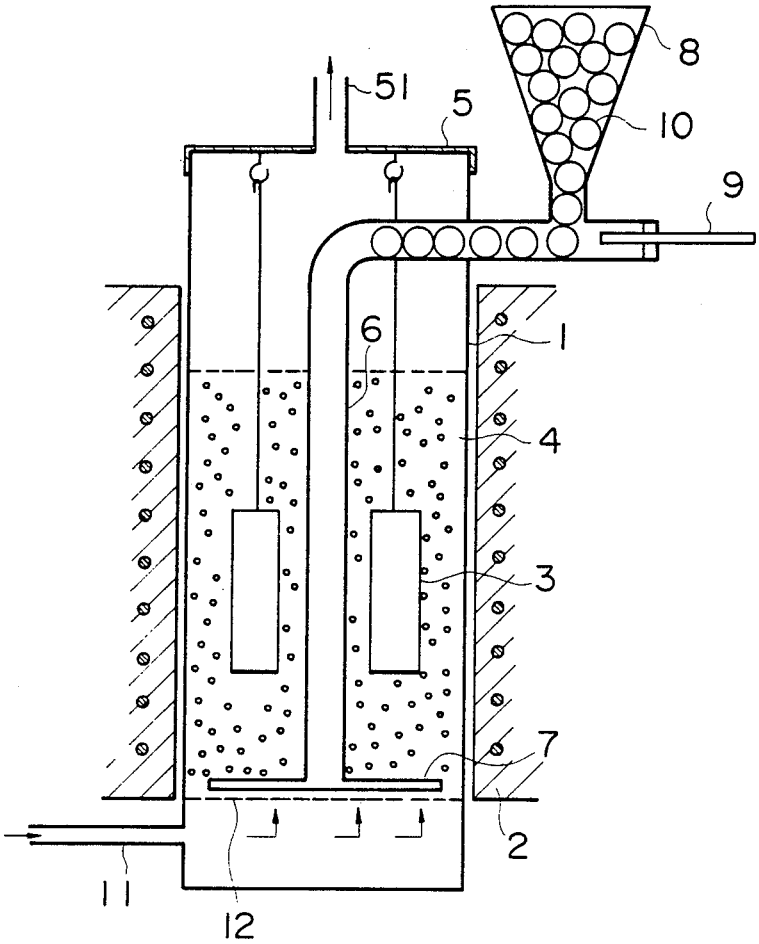

Heat treatment was carried out using a fluidized bed-type furnace as shown in FIG. 4, with 1 kg of treating agent placed on the gas diffuser plate 12. The treating agent is composed of 60% of alumina powder (80–100 mesh) and 40% of chromium powder (100–200 mesh). Then, argon as the fluidizing gas was introduced under a pressure of 1.5 $kg/cm^2$ at a flow rate of 140 cm/min into the furnace (1) through the gas inlet (11). The treating agent became fluidized, forming the fluidized bed (4).

Figure 5:
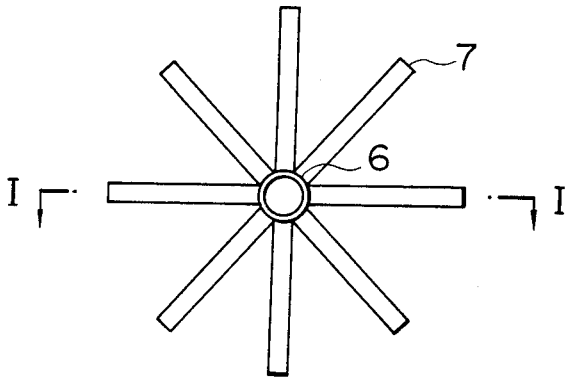
Figure 6:
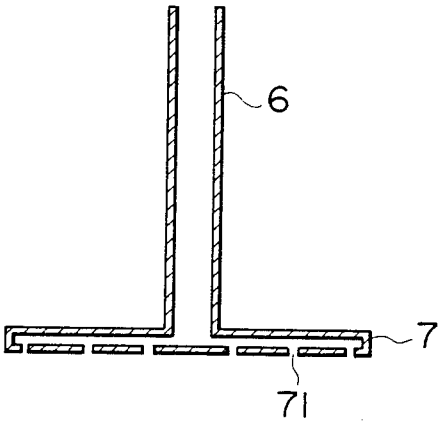

Right over the gas diffusing plate in the lower part of the fluidized bed are radially arranged eight distribution pipes (7) to blow out the active agent gas. They are connected to the active agent supply pipe (6) as shown in FIGS. 5 and 6. The supply pipe (6) has an inside diameter of 9 mm, and the distribution pipe (7) has an inside diameter of 3 mm. Each distribution pipe (7) has three exit holes (71), 0.5 mm in diameter, on its lower side.

Then, two articles to be treated (3), made of high speed tool steel SKH51, measuring 7 mm in diameter and 50 mm in height, were suspended in the middle of the fluidized bed by means of supporters attached to the inside of the lid. With the top of the furnace proper tightly closed with the lid (5), the fluidized bed was heated to 560° C. Argon was switched to a 1:1 mixed gas of ammonia and nitrogen, which was introduced under the same pressure and at the same flow rate as argon.

Ammonium chloride powder as the active agent which was formed into pellets (each weighing 0.4 g and measuring 7 mm in diameter and 7 mm in height) using an oil press was placed in the hopper (8). With the top of the hopper closed, two pieces of the ammonium chloride pellets were dropped into the supply pipe by pushing with a rod (9). Their amount is equivalent to 0.08% of the total amount of the treating agent. One hour after the start of heat treatment, one more piece of the ammonium chloride pellet was added. After treatment for 2 hours, the lid was removed and the treated articles were taken out of the furnace and quenched in oil.

Then, two articles to be treated of the same composition and shape as mentioned above were placed in the middle of the fluidized bed. Treatment was carried out in the same manner as mentioned above while supplying the ammonium chloride pellets one after another. This step was repeated four times.

Upon visual inspection, the surface of the treated article was found to be smooth and free of the treating agent and uneven color. The microscopic observation revealed that the coating layer formed on the treated article was uniform across thickness (12–13 μm). Upon examination by X-ray diffraction, this layer gave the diffraction line characteristic of CrN and $F_{2-3}N$. The surface of the layer was subjected to point analysis with an X-ray microanalyzer. There was detected 28.7% of Cr, N, and C. In view of the fact that X-rays penetrate about 10 μm from the surface and the electron rays (as the radiant source of the X ray analyzer) penetrate 2–3 μm from the surface, it was confirmed that the surface layer formed in this example is composed of an outer layer of chromium-iron carbonitride $(Cr,Fe)_o(C,N)_p$ and an inner layer of iron carbonitride $Fe_m(C,N)_n$.

The adhesion of the surface layer was as good as that in Example 1 when evaluated by using a Rockwell hardness tester.

EXAMPLE 3

Figure 7:
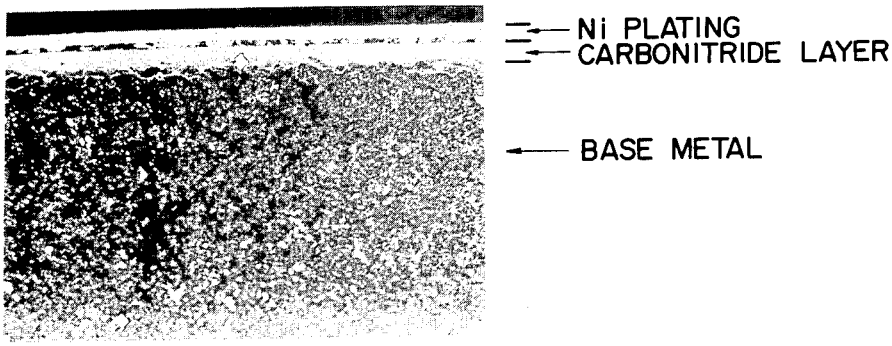
Figure 8:
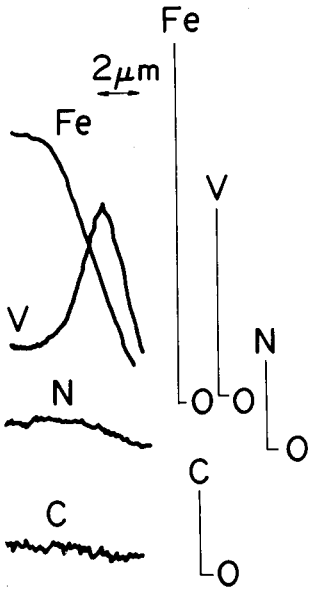

Heat treatment was carried out using the same fluidized bed-type furnace as in Example 1 under the same conditions as in Example 1 except that the treating agent was replaced by the one composed of 58.8% of alumina powder (80–100 mesh), 40% of ferrovanadium powder (100–200 mesh), and 1.2% of vanadium trichloride powder (100–200 mesh); the ratio of ammonia to nitrogen in the mixed gas was changed to 1:9; and the treating temperature and time were changed to 600° C. and 3 hours, respectively. The heat treatment provided a smooth layer being about 10-μm thick and having the cross-section as shown by a microphotograph in FIG. 7. The distribution of elements across the cross-section was examined using an Xray microanalyzer. There were detected V, Fe, N, and C on the top surface as shown in FIG. 8. It was confirmed from this result that the surface layer is composed of vanadium-iron carbonitride $(V,Fe)_o(C,N)_p$. The adhesion was good as in other examples.

EXAMPLE 4

Heat treatment for carbonitride coating was carried out under the same conditions as in Example 1 except that the treating agent was replaced by the one composed of 50% of alumina powder (80–100 mesh), 40% of ferrotitanium powder (100–200 mesh), and 10% of ammonium chloride powder (80–200 mesh).

Figure 9:
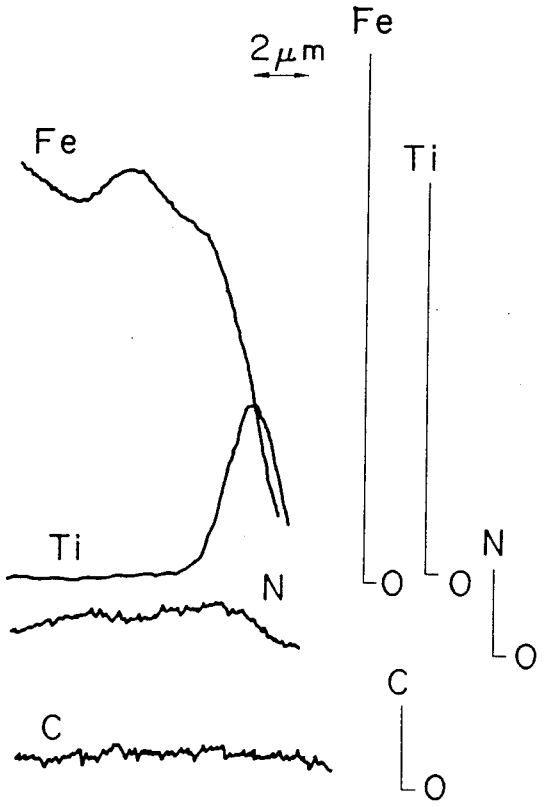

The distribution of elements across the cross-section of the coating layer formed on the surface of the treated article SKH51 was examined by line analysis with an X-ray microanalyzer. There were detected Ti, Fe, N, and C in the outer layer and Fe, N, and C in the inner layer as shown in FIG. 9. Upon examination of this layer by X-ray diffraction, diffraction attributable to TiN was noticed. It was confirmed from these results that the surface layer formed in this example is composed of an outer layer of titanium-iron carbonitride $(Ti,Fe)_o(C,N)_p$ and an inner layer of iron carbonitride $Fe_m(C,N)_n$. The adhesion was good as in other examples.

What is claimed is:

1. A method of forming a nitride or carbonitride layer of at least one metal selected from the group consisting of chromium, vanadium and titanium on the surface of an iron or iron alloy article, which comprises the steps of:

(a) disposing in a fluidized bed furnace a treating agent comprising a refractory powder, a metal powder of at least one metal selected from the group consisting of chromium, vanadium, titanium and a metal containing at least one of said chromium, vanadium and titanium, and a halide powder; and introducing a nitrogen-containing gas into said fluidized bed furnace;

(b) heating said fluidized bed furnace to a temperature which is not higher than 650° C.; and (c) disposing said article in said fluidized bed furnace during or after said steps (a) and (b).

2. A method according to claim 1, wherein step (b) precedes introducing a nitrogen-containing gas into said fluidized bed furnace.

3. A method according to claim 1, wherein said nitrogen-containing gas is a member selected from the group consisting of a nitriding gas, a mixed gas of a nitriding gas and a carburizing gas, said nitriding gas with an inert gas, and said mixed gas with an inert gas.

4. A method according to claim 1, wherein said halide powder is at least one member selected from the group consisting of a halogenated ammonium salt, a metal halide, an alkali metal halide, and an alkaline earth metal halide which is sublimable or vaporizable at a temperature not higher than a treating temperature.

5. A method according to claim 1, wherein said treating agent has a particle size of from 60 to 350 mesh.

6. A method according to claim 1, wherein the amount of said halide powder is in the range of 0.05 to 20% based on the total amount of the refractory powder and the metal powder.

7. A method according to claim 1, wherein a halide is further supplied to said fluidized bed furnace from outside.

8. A method according to claim 7, wherein said halide is in the form of pellets.

9. A method according to claim 1, wherein coarse refractory particles having a grain size of from 5 to 20 mesh are further disposed in the furnace between a gas inlet thereof and the treating agent, thereby preventing said gas inlet from being clogged due to said treating agent.

10. A method of forming a nitride or carbonitride layer of at least one member selected from the group consisting of chromium, vanadium and titanium on the surface of an iron or iron alloy article, which comprises the steps of:

(a) disposing in a fluidized bed furnace a treating agent comprising a refractory powder and a metal powder of at least one member selected from the group consisting of chromium, vanadium, titanium and a metal containing at least one of said chromium, vanadium and titanium; and introducing a nitrogen-containing gas into said fluidized bed furnace;

(b) heating said fluidized bed furnace to a temperature which is not higher than 650° C.;

(c) disposing said article in said fluidized bed furnace during or after said steps (a) and (b), and (d) introducing an active agent composed of a halide from outside into said fluidized bed furnace during or after said steps (a) to (c).

11. A method according to claim 10, wherein step (b) precedes introducing a nitrogen-containing gas into said fluidized bed furnace.

12. A method according to claim 1 of forming a nitride or carbonitride layer of chromium on the surface of an iron or iron alloy article and wherein the treating agent comprises a metal powder of chromium or of a metal containing chromium.

13. A method according to claim 1 of forming a nitride or carbonitride layer of vanadium on the surface of an iron or iron alloy article and wherein the treating agent comprises a metal powder of vanadium or of a metal containing vanadium.

14. A method according to claim 1 of forming a nitride or carbonitride layer of titanium on the surface of an iron or iron alloy article and wherein the treating agent comprises a metal powder of titanium or of a metal containing titanium.

15. A method according to claim 10 of forming a nitride or carbonitride layer of chromium on the surface of an iron or iron alloy article and wherein the metal powder is that of chromium or of a metal containing chromium.

16. A method according to claim 10 of forming a nitride or carbonitride layer of vanadium on the surface of an iron or iron alloy article and wherein the metal powder is that of vanadium or of a metal containing vanadium.

17. A method according to claim 10 of forming a nitride or carbonitride layer of titanium on the surface of an iron or iron alloy article and wherein the metal powder is that of titanium or of a metal containing titanium.

18. A method according to claim 1 which is a single-treating-step method.

19. A method according to claim 10 which is a single-treating-step method.

* * * * *